US009187915B2

(12) United States Patent
Jung

(10) Patent No.: US 9,187,915 B2
(45) Date of Patent: Nov. 17, 2015

(54) METHOD FOR CONSTRUCTING BUILDING MADE OF DRIED SOIL AND TEMPORARY FRAME USED IN SAME

(71) Applicant: Moon-Hyoung Jung, Danyang-gun (KR)

(72) Inventor: Moon-Hyoung Jung, Danyang-gun (KR)

( * ) Notice: Subject to any disclaimer, the term of this patent is extended or adjusted under 35 U.S.C. 154(b) by 0 days.

(21) Appl. No.: 14/372,489

(22) PCT Filed: Jan. 17, 2013

(86) PCT No.: PCT/KR2013/000361
§ 371 (c)(1),
(2) Date: Jul. 16, 2014

(87) PCT Pub. No.: WO2013/109058
PCT Pub. Date: Jul. 25, 2013

(65) Prior Publication Data

US 2014/0352251 A1 Dec. 4, 2014

(30) Foreign Application Priority Data

Jan. 17, 2012 (KR) ..... 10-2012-0005379
Jan. 16, 2013 (KR) ..... 10-2013-0004866

(51) Int. Cl.

| | |
|---|---|
| ***E04B 1/16*** | (2006.01) |
| ***E04G 13/00*** | (2006.01) |
| ***E04B 2/84*** | (2006.01) |
| ***E04C 5/00*** | (2006.01) |
| ***E04C 5/16*** | (2006.01) |
| *E04B 2/86* | (2006.01) |

(52) U.S. Cl.
CPC . *E04G 13/00* (2013.01); *E04B 2/84* (2013.01); *E04C 5/00* (2013.01); *E04C 5/168* (2013.01); *E04B 2002/8682* (2013.01)

(58) Field of Classification Search
CPC ..... E04B 2/84; E04B 2/842; E04B 2/845; E04B 1/35; E04B 1/3505; E04G 11/08
USPC ..... 52/742.13, 742.14; 249/47, 40, 44, 193, 249/192, 191; 264/31, 33
See application file for complete search history.

(56) References Cited

U.S. PATENT DOCUMENTS

| | | | | | |
|---|---|---|---|---|---|
| 1,365,125 | A | * | 1/1921 | Schroeder | 52/687 |
| 1,655,676 | A | * | 1/1928 | Daggett | 264/33 |
| 2,844,024 | A | * | 7/1958 | McDonald | 52/326 |
| 3,238,684 | A | * | 3/1966 | Wood | 52/379 |
| 3,712,576 | A | * | 1/1973 | Dagiel | 249/192 |
| 4,234,156 | A | * | 11/1980 | Wepf | 249/40 |
| 5,355,653 | A | * | 10/1994 | Henri | 52/742.13 |
| 5,655,350 | A | * | 8/1997 | Patton | 52/742.13 |

(Continued)

FOREIGN PATENT DOCUMENTS

| | | | | |
|---|---|---|---|---|
| JP | 04174173 A | * | 6/1992 | E04G 17/065 |
| JP | 2001-311234 | | 11/2001 | |

(Continued)

*Primary Examiner* — Christine T Cajilig
(74) *Attorney, Agent, or Firm* — Lex IP Meister, PLLC

(57) ABSTRACT

The technical features of the present invention are for a method for quickly and easily constructing a building made of soil such as a house or a retaining wall by means of a process of installing a temporary mold in a frame member made of a mesh, compacting pugging clay into the temporary mold in a bottom-up method by a mechanical extruder, and immediately removing the temporary mold and drying the pugging clay.

3 Claims, 3 Drawing Sheets

(56) References Cited

U.S. PATENT DOCUMENTS

| | | | | |
|---|---|---|---|---|
| 5,819,496 | A * | 10/1998 | Sperber | 52/742.13 |
| 5,852,907 | A * | 12/1998 | Tobin et al. | 52/714 |
| 5,861,105 | A * | 1/1999 | Martineau | 249/44 |
| 6,231,024 | B1 * | 5/2001 | Kugimiya et al. | 249/33 |
| 6,322,047 | B1 * | 11/2001 | Holmboe, Jr. | 249/219.2 |
| 6,826,880 | B2 * | 12/2004 | Yost et al. | 52/309.11 |
| 7,033,116 | B1 * | 4/2006 | Ward et al. | 405/229 |
| 7,073,306 | B1 * | 7/2006 | Hagaman | 52/745.09 |
| 7,467,777 | B2 * | 12/2008 | Huber et al. | 249/214 |
| 2005/0275124 | A1 * | 12/2005 | Franklin | 264/31 |
| 2006/0277855 | A1 * | 12/2006 | Westra | 52/309.11 |
| 2008/0110118 | A1 * | 5/2008 | Molina | 52/379 |
| 2009/0000241 | A1 * | 1/2009 | Long, Sr. | 52/742.14 |
| 2009/0272876 | A1 * | 11/2009 | McNamara | 249/192 |
| 2010/0251651 | A1 * | 10/2010 | Mahe et al. | 52/426 |
| 2010/0319275 | A1 * | 12/2010 | O'Leary | 52/173.1 |
| 2011/0131908 | A1 * | 6/2011 | Lee | 52/283 |
| 2011/0277410 | A1 * | 11/2011 | Richardson et al. | 52/426 |
| 2012/0087742 | A1 * | 4/2012 | Ogorchock | 405/262 |
| 2012/0286134 | A1 * | 11/2012 | Rojas Pimienta | 249/192 |
| 2012/0311949 | A1 * | 12/2012 | Mathe et al. | 52/309.4 |

FOREIGN PATENT DOCUMENTS

| | | |
|---|---|---|
| KR | 1019950018983 | 7/1995 |
| KR | 10-2006-0057235 | 5/2006 |
| KR | 10-2009-0110784 | 10/2009 |
| KR | 10-2010-0026206 | 3/2010 |

* cited by examiner

METHOD FOR CONSTRUCTING BUILDING MADE OF DRIED SOIL AND TEMPORARY FRAME USED IN SAME

TECHNICAL FIELD

The present inventions relates a method for constructing the building mainly composed of soil and the temporary frame used in this method, and more particularly, the present invention relates to a so-called wet construction method to construct the structures such as walls of buildings or retaining walls by compacting pugging clay into a frame member which is composed of cage shaped mesh.

BACKGROUND TECHNOLOGY OF INVENTION

It is probably safe to say that the natural building materials such as soil, wood and stone have been used in constructing the buildings for a long time along with human history.

In particular, comparing to stone or wood, soil has been used as a building material since ancient times because it is a common material which can be obtained everywhere. However, because it is poor in the mechanical strength and durability as a building material and because it has a poor image in its appearance, it has not been used as a mainstream material as compared to stone or wood.

However, since various bio-friendly and eco-friendly characteristics of soil have been newly recognized, soil is receiving the attention as a building material in the future.

In other words, the processing materials such as concrete, which are widely used as building materials today, destroy the nature from the manufacturing process and consume a large amount of energy, which result in increase of the emissions of carbon dioxide, which is a pollutant, as well as concrete wastes generated during the dismantling process contaminate the soil and damage the natural ecosystems in the end. In comparison, even if the soil buildings are dismantled after the life of the building has ended, the soil returns to the nature as it is, which can emphasize that there is no risk of corrupting or contaminating the natural ecosystems. In this point, the soil can be said as a representative of environmentally friendly materials more than anything.

In addition, as all living organisms are born from the soil and return to the soil, all organisms are inseparable from the soil. Therefore, the building which is mainly composed of the soil function as a space of a comfortable life, which is based on the various characteristics of the soil good for the human body, such as the functions of automatic temperature and humidity control, sterilization and deodorization, and radiation of far-infrared, which we can say that the soil is a bio-friendly material.

As stated above, while the soil has various eco-friendly and bio-friendly advantages, due to plain and simple appearance as well as other issues in robustness and durability, the soil has been used as the building materials with improved strength and durability such as bricks by burning the soil or by processing the soil with settlement agents.

However, in these building materials, the natural characteristics of soil are weakened or changed, let's leave them out of the discussion. If we examine the conventional construction methods using the soil as a main material, it is roughly classified into the wet construction methods and the dry construction methods.

First, the dry construction method can be divided into masonry type and compaction type. The masonry type is a method of construction to lay up block bodies, that are made by molding the soil inserted into the frame, using the methods such as bricklaying while the compaction type is a method of construction where the soil is filled into a form and compacted using a pounder and others, and this process is repeated to fill and compact the soil for constructing the wall.

As explained above, as the dry construction method does not use the water during the construction process, any separated drying process is not needed, as well as it does not demand any special construction technology. For this reason, it has an advantage of easy-to-construct, but this type of structure is weak against the lateral forces such as shear force, which has inefficient aspects of unnecessarily requiring a thicker wall and extremely low seismic performance and this structural weaknesses prevents this construction method from application to the large size buildings higher than the second floor.

Next, the wet construction methods include the pugging clay paint-over method, soil spray method, and recently developed pugging clay filling method.

Of these methods, the pugging clay paint-over method that has been used since ancient times, is a method to construct the wall by repeating the manual process daubing with the pugging clay inside and outside the core material which was made by weaving the plants such as stalks of millet.

It can be said that this method has been progressed one step in view of having reinforced the shear force and the earthquake resistance which are the greatest weaknesses of the construction of soil by enhancing the core material, however, due to a matter of primitiveness and effort of manual labor, the soil spray method where lath steel meshes instead of the core material of plants are arranged on the form materials and the soil and water or pugging clay are sprayed for paint-over using the mechanical equipment such as in shotcrete is partially used these days.

However, the so called dry construction method using this method where spraying the soil and water separately, has a problem that the soil is washed away during the process of spray or the soil is not properly kneaded, while the so called wet construction method where spraying pugging clay, has a problem that the mechanical equipment has often troubles by stuck clay due to its viscosity, which limits its application only to covering the soil wall thinly on already constructed wall and cannot be utilized for regular wall construction.

Finally, the pugging clay filling method is a construction method which has been recently developed and registered by this inventor as the Korean Patent No. 10-1003371 (Dec. 16, 2010) as a prior art considering the problems in the conventional wet construction as described above.

The prior invention described above regards to the frame member (10) composed of cage shaped wire mesh which is connected by a number of grid nets (13) between the front nets (11) and the rear nets (12) which are installed oppositely each other as shown in FIG. 1. This frame member performs the functions of the form and the reinforced rebar at the same time, if compared to concrete work.

The above described frame member is able to function as a shape retaining member without the formwork, which results from the clay specific-viscosity and plasticity which are realized when the soil becomes pugging.

In other words, unlike the concrete kneading which has a distinguished liquidity, if the pugging clay is poured into the frame member due to its strong viscosity and plasticity compared to liquidity, the pugging clay not only sticks on dense nets composed of wire mesh but also is not easily pushed out of wire mesh due to the plasticity that tends to maintain its form as long as the external force does not act.

Therefore, it can be considered that the prior invention has devised a new construction method for innovative structural form making the most of properties of the clay, however, the clay-specific viscosity and plasticity act as a double edged sword in the actual construction process as described above, and result in the reduced efficiency, which should be improved.

In other words, if we try to pour the pugging clay into the frame member, the pugging clay gets stuck immediately to wire mesh by the viscosity as described above, and if we try to mince the pugging clay using a pestle, the shape gets only distorted due to its unique plasticity, which makes it difficult to fill the frame member densely.

After all, this method has a problem that the construction efficiency gets significantly reduced in terms of construction period and manpower, because the work must be carried out manually one by one with hand tools in order to pour properly the pugging clay into the frame member. The existing mechanical spray method also exposed the same problem in the conventional spray method.

DETAILED DESCRIPTION OF INVENTION

Technical Task

The present invention, as described above, has its purpose to provide a comfortable soil building by a construction method with higher construction efficiency in the consideration of various problems raised in the soil building, in particular using the frame member disclosed in the prior invention of the present inventor.

Means for Solving the Problems

The objective of the present invention, as described above, is achieved by the technical features which organically link the characteristics of viscosity and plasticity of the pugging clay to the technical means such as the frame member having the characteristics of shape retention, the temporary formwork attached to the outer peripherals of the said frame member for functioning the template, and the mechanical extrusion device for injecting the pugging clay into the said temporary formwork.

That is, while the frame member, a fundamental component of the present invention, has an advantage of shape retention ability when filled with the pugging clay, as described above, the frame member has also a problem that it is very difficult to be filled without any gap because of the pudding clay-specific plasticity and viscosity.

This invention is basically characterized by the solution of such filling problem by installing a means of temporary formwork on the outer peripherals of the frame member, into which the pugging clay is injected with a mechanical extrusion means, but upwards from the bottom of the said temporary formwork, which is so called consolidated bottom-up filling method.

In addition, the present invention is technically characterized by an installation method that a hanging means is directly applied to the temporary form to be mounted directly to the frame member without a supporting and reinforcing structure using the characteristics of shape retention of the frame member in this invention, i.e., that the lateral pressure acting on the formwork mitigates significantly in order to raise the convenience or effectiveness in the construction when installing and disassembling the said temporary form.

Effect of Invention

It can be said that this invention depends on the technical results that the technical features as described above, i.e., the shape retention characteristics of the frame member, the template function of the temporary form and injection function of the mechanical extrusion device organically links to the characteristics of the pugging clay. And, if it is compared to the concrete form which looks like a similar technology at a glance, the effect is more apparent.

That is, concrete forms, given that concrete is cast being dropped to the downward direction from the top, must, in this case, put up with, in addition to self-weight of concrete's own, powerful vibrating pressure generated due to vibrators during work of compaction, while furthermore requiring water-tight structure so that water necessary for concrete curing is not leaked through the form, whereby high degree of construction precision and rigidity is required.

Despite the foregoing, in light of such features that the temporary mold of this invention is not only capable of, by its frame member, enduring earth pressure of pugging clay to be compacted, but does not require preciseness and rigidity for the work without need of watertight structure, its supporting system is sufficient by way of simple hanger engaged to the frame member, in contrast with a concrete form having solid and complicated supporting system; in this sense, the temporary mold hereunder provides the effect of making sure construction convenience and speediness in constructing or dismantling a structure.

What is more, whereas concrete forms have to remain installed throughout the curing period for 28-day strengths, thereby making it impossible to recycle them in the construction site for that period, the temporary mold of this invention offers economic benefit in light of higher rate of reusability because it is removable promptly once compacting work has been completed.

Moreover, the present invention allows pugging clay to be compacted, on a large scale and quickly, into the inside of the temporary mold by way of a mechanically extruding device, the reason of which is that the inner circumferential surface of the temporary form functions as smooth surface encouraged due to high viscosity characteristic in pugging clay, thus making it to be pushed in more smoothly.

In other words, the stickier behavior of viscosity pugging clay exhibits uniquely is generally surface perpendicular, as if an absorptive stuck to glass is not easy to take it off perpendicularly to the glass surface, but is easy to slip it in parallel to the surface; likewise, the temporary mold of this invention allows clays, although forcibly compacted through input holes, to be easily flown into the vacant space of the temporary mold with lateral pressure not significantly subjected to the walling structure thereof.

Therefore, if pugging clay is squashed from the lower part of the temporary mold to the direction in parallel with the wall plane of the mold by using such flow characteristics, the squashed clay becomes thicker along the vacant space from the bottom, no voids will occur, so compressive compaction is achievable more effectively.

To conclude, the present invention pertains to a temporary mold enables one to be able to compact and coat large bulk of pugging clay to frame members by using a mechanical extrusion device in a quick manner and easily install or dismantle the temporary mold itself, which accordingly not only improves construction convenience and speed remarkably than the conventional method relying on handwork and hand tools for filling and compacting, but has an effect of enhancing construction integrity since pugging clay is packed to every corner of the frame member part to be compact filled.

DESCRIPTION OF SYMBOLS IN THE KEY PART OF THE DRAWINGS

Figure 1:
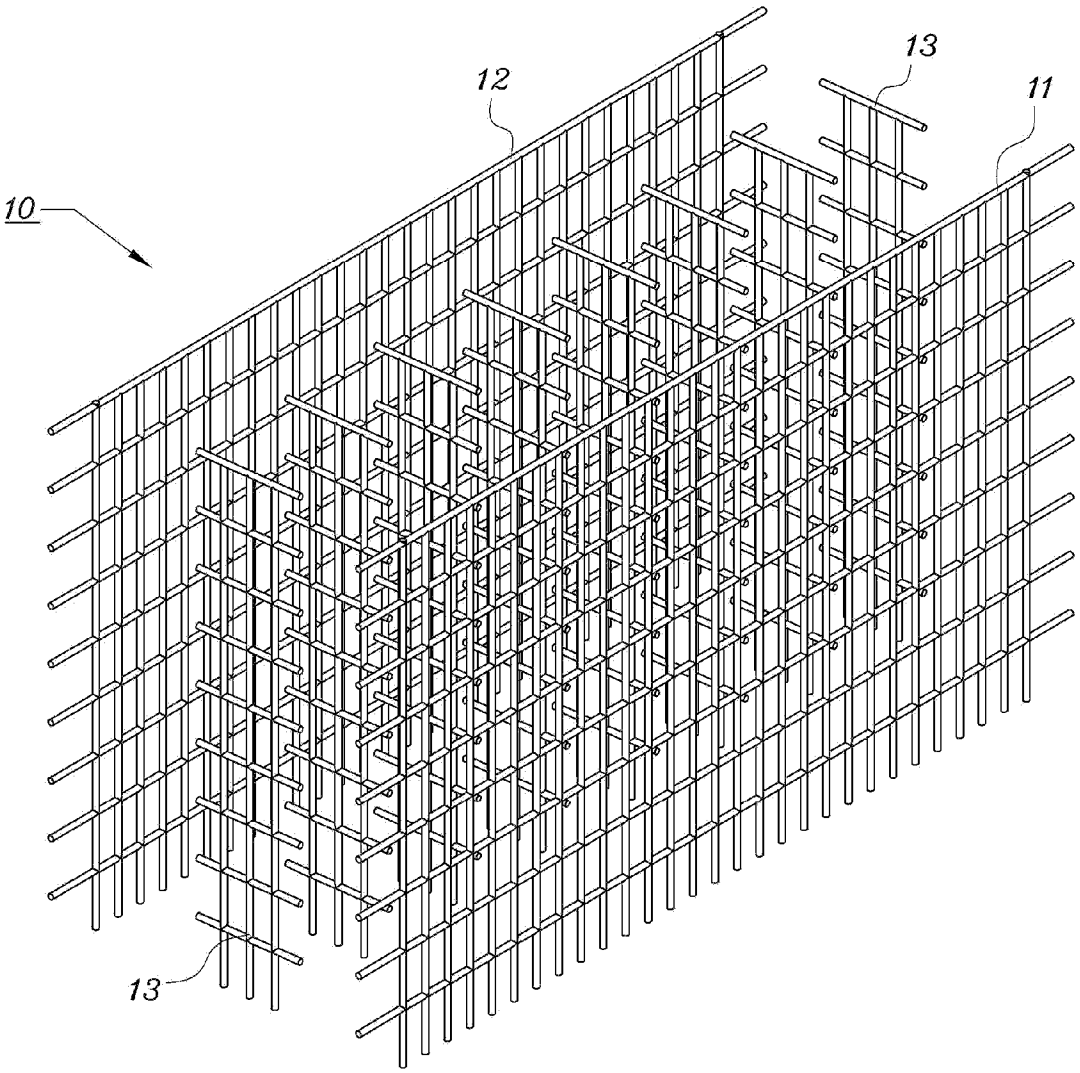
FIG. 1 is a perspective view of disassembly that shows a frame member, taken from a prior invention by the present invention.

10: Frame member made of mesh 20: Temporary mold
21: Mold plate 23: Hanger
25: Input hole 30: Concrete foundation Best Form for Implementation of Invention Hereunder is the detailed description with respect to the best form of embodiment of the present invention by referring to the drawings attached hereof.

As depicted in FIG. 1, a frame member (10) of the present invention is constructed in a cage shape of mesh, comprising; mutually opposite front mesh (11) and rear mesh (12) with plural number of spacing mesh (13) that connects the said front and rear meshes with each other.

The said cage shaped mesh is desirable to make up in a lattice form and be made of metallic material such as steel wire; however, it is of course to configure it with the use of synthetic resin or wood material.

Figure 2:
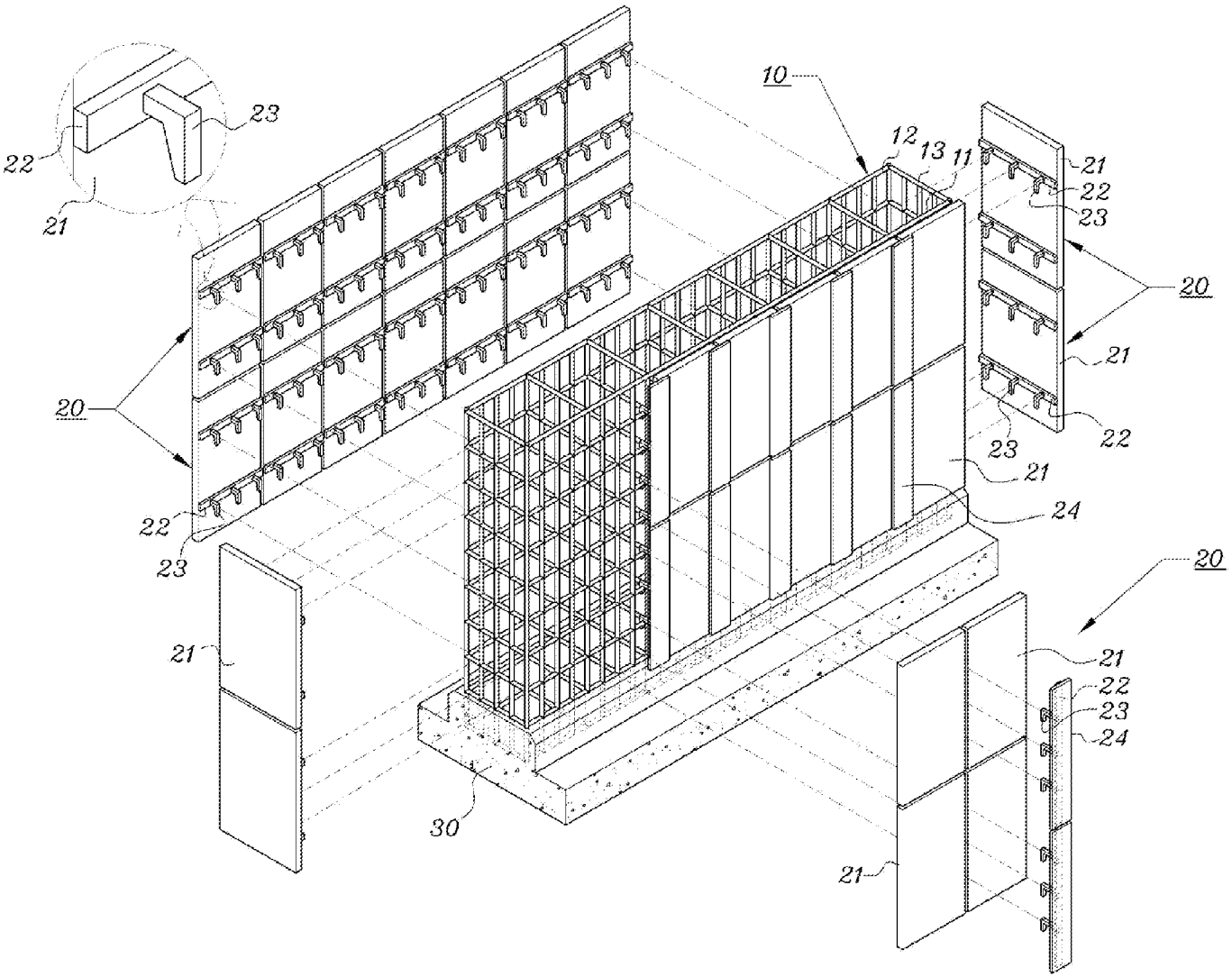
FIG. 2 is a perspective view that shows a temporary mold is installed in the aforementioned frame member.

And, said frame member (10) is made, as shown in FIG. 2, with temporary frame (20) installed so that the front/rear and left/right sides of the frame member are closed, wherein in one side of the lower part of the said temporary frame (20) an input hole (25) is formed through which plugging clay is to be poured.

It is desirable that a spacer or similar is applied, during the formwork, between the outer circumferential surface of mesh of said frame member (10) and the temporary frame (20) to let there be a slight gap so as to coat the mesh if necessary, while the lower part of the said mesh is connected to a concrete foundation (30) or rebar system of an edge beam, etc., for structural stabilization.

Although the said temporary frame (20) is made of either wood, synthetic resin or metallic plate material, it is desirable to adopt segmented unit members in a form of module recyclable for repetitive use of assembly. Meanwhile, as the temporary frame of this invention does not require rigidity or water tightness unlike that of concrete forms, there is no problem even though slight crevices are created in between unit members; furthermore, it does not necessarily need a certain propping structure with rigidity, but is supportable sufficiently by only using ordinary engagement means and support reinforcing members.

FIG. 2 demonstrates another technological feature of this invention, i.e. a hooking type, which shows two structural forms the temporary mold (20) can have, wherein the temporary mold (20) adopting a hooking type has a means of hooking mounted on a mold plate (21) so as to be able to be directly engaged to the mesh of a frame member (10); in such a manner, installing and dismantling a temporary mold (20) can conveniently be done without separate engagement means, support reinforcing member or strut.

In other words, as two rows of supports (22) with appropriate intervals are laid longitudinally in a mold plate (21) installed at the rear surface of a frame member (10), wherein a multiple of hangers (23) are mounted on the said supports (22) so that mold plates (21) can directly be hooked with a frame member (10) by using these hanger (23) to install a temporary mold (20).

On the other hand, another form of structure is shown that, as for a temporary mold (20) installed at the front side of a frame member (10), a mold plate (21) having no hanger is installed by connecting it through a hanger (23) mounted on a separate support bar (24).

The configuration for installing a temporary mold (20) in this case is that, in a state that two mold plates (21) are made mutually adjacent with a slight gap in between and then the closely adjacent section is pressed by the said support bar (24) to get in contact with a frame member (10), a hanger (23) mounted on a central support part (22) of the said support bar (24) allows a frame member (10) to be hooked with a mesh through the said gap.

Figure 3:
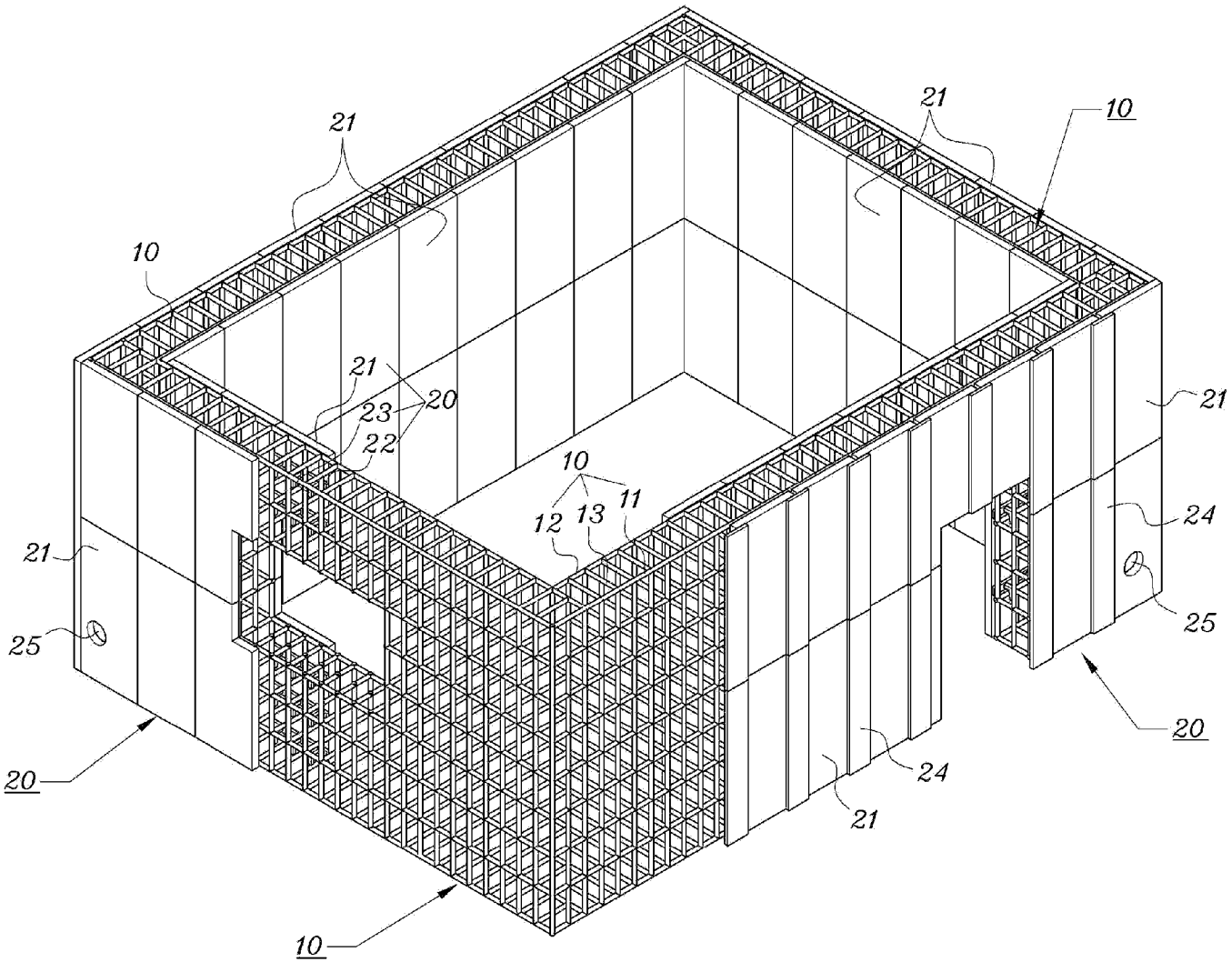
FIG. 3 is a perspective view that as an example shows the process of constructing a walling system of a house.

Although FIG. 2 and FIG. 3 exhibit, for convenience, all the two structural types applicable for construction, it is desirable in reality to select one out of the two types, and it is desirable to configure so that, regardless of whichever type may be, the lower profile of the said hanger (23) is comparatively wide as far as possible and the upper profile thereof forms a small gap roughly identical to the diameter of the mesh.

And, although an input hole (25) for pugging clay that is formed in said temporary mold (29) must have been made at the lower part of the corresponding temporary mold (20) so that pugging clay can be input/compacted with a type of bottom-up, it is desirable that it is formed, to the extent practicably possible, to the lateral side thereof rather than front or back side.

In this case, it causes no problem that the top part of the temporary mold (20) is kept open, not closed, because pugging clay when cast through an input hole (25) of the lower part of the mold gets filled pushing upward gradually from the bottom, causing no voids to occur; when filling is tightly made up to the top, finishing a walling structure can be done by just straightening the uppermost surface that is open to the air.

Further, by way of co-using transparent or semi-transparent material mold plates (21) punctuated in the said temporary mold (20), it is also possible to visually assess how high filling of clay is progressed.

As described above, pugging clay to be compacted/filled to the inside of the temporary mold (20) uses one made by kneading natural soil as it is, it is desirable to mix lightweight aggregate such as expanded pearlite or expanded vermiculite.

These lightweight aggregates available after processing in the factory are in the range of 0.1 mm 3 mm of grain size; the content ratio with soil is controlled to be in the range of about 30-40% in terms of weight ratio and then minutely adjusted for viscosity, plasticity and fluidity as desired by mixing lightweight aggregates to the mixture of soil and water in a state of being aged to some extent after pasting, where it can be seen as appropriate if the content is slightly leaked from between fingers when loosely grasping a handful of mixture by hand.

Once the mixing ratios of mixture (soil and water) and lightweight aggregates have been determined as such, they will be input to and pasted by a large-size mechanical mixer; and the paste produced (pugging clay) will be compacted, in an extruding way, to a temporary mold (20) through an input hole (25) forced by a mechanically extruding device relying on screw type or piston type.

As hinted in FIG. 3 that shows the process of constructing a walling structure of house, it is desirable to first of all perform work for concrete foundation (30) and then anchor a mesh system that is a frame member of this invention to reinforced steel bars of the said concrete foundation (30) so that subsequent works are made in a state that frame members put into complete assembly to four-side walling systems are stabilized as a whole.

In that regard, in a state that openings for doors or windows are removed in advance, door frame, window frame and other necessary facilitation like piping for electrical wiring are buried and then temporary molds (20) will be installed to frame members (10) starting from one walling structure, where mold releasing agent is treated or vinyl film or non-woven burlap is applied if necessary to make easier mold release and then pugging clay will be compacted into the temporary mold (20) through the input hole (25) formed at its lower part by using a mechanical extrusion device not depicted here.

Once the filling of clay to a temporary mold (20) with respect to one walling structure has been fully completed, the said temporary mold (20) will be immediately unlocked and removed and the bare wall surface be dried, where the dismantled temporary mold (20) will be reused by attaching it to the subsequent walling structure; in such a way, internal compartment walls, let alone four-round external walls, will be constructed in order.

The aforementioned sequence of construction of course varies depending on size of a building or the circumstance of the construction site, for instance, to construct multiple walls in one shot or make up even single wall by segmenting it into two or more sections. Each walling structure once constructed will be subject to finishing to its internal and external sides with the use of a variety of interior/exterior materials.

Besides, it goes without saying that the present invention is applicable for, in addition to architectural structure like housing, construction of fence wall or retaining wall for vegetation, and manufacture of constructional material made mainly of soil.

The invention claimed is:

1. A method of constructing a soil structure or building by compacting pugging clay into a frame member which is composed of cage shaped meshes, the method comprising:

installing a temporary formwork on outer peripherals of the frame member, into which the pugging clay is compactly injected through a pugging clay input hole formed at one side bottom of the temporary formwork with a mechanical extrusion device, upwards from the bottom of the temporary formwork, using a bottom-up method;

removing the temporary formwork after the pugging clay is injected through the pugging clay input hole; and drying the pugging clay after the removing of the temporary formwork.

2. The method of aim 1, wherein the installing the temporary formwork comprises mounting the temporary formwork directly to the meshes of the frame member using a hanger.

3. The method of claim 2, wherein:

the temporary formwork comprises a mold plate at which the plugging clay input hole is formed and a support member formed on a surface of the mold plate; and the temporary formwork further comprises the hanger that is protrudingly formed on the support member.

* * * * *